United States Patent [19]

Nishi et al.

[11] Patent Number: 4,561,045

[45] Date of Patent: Dec. 24, 1985

[54] ILLUMINATED DISPLAY ASSEMBLY

[75] Inventors: Hiroyuki Nishi; Mitsuji Hayashi, both of Nagaokakyo; Motoyuki Tomizu, Kyoto, all of Japan

[73] Assignee: Omron Tateisi Electronics Co., Kyoto, Japan

[21] Appl. No.: 601,764

[22] Filed: Apr. 18, 1984

[30] Foreign Application Priority Data

Jan. 27, 1983 [JP] Japan ..... 58-58586[U]

[51] Int. Cl.[4] ..... F21V 17/00

[52] U.S. Cl. ..... 362/368; 362/394; 362/95

[58] Field of Search ..... 362/368, 394, 382, 802, 362/95; 315/362; 200/51.16

[56] References Cited

U.S. PATENT DOCUMENTS

| | | | |
|---|---|---|---|
| 1,734,565 | 11/1929 | Douglas | 362/394 |
| 1,761,437 | 6/1930 | Douglas | 362/394 |
| 1,778,186 | 10/1930 | Douglas | 362/368 |
| 1,928,413 | 9/1933 | Douglas | 362/394 |
| 2,087,935 | 7/1937 | Batcheller | 362/394 |
| 2,242,165 | 5/1941 | Batcheller | 362/394 |
| 2,273,353 | 2/1942 | Harris | 362/95 |
| 3,116,480 | 12/1963 | Fernquist | 362/368 |
| 3,192,352 | 6/1965 | Piber | 362/95 |
| 4,363,087 | 12/1982 | Graham et al. | 362/382 |

*Primary Examiner*—Raymond A. Nelli

*Attorney, Agent, or Firm*—Wegner & Bretschneider

[57] ABSTRACT

An illuminated display assembly comprising a light emitting member, a socket base member, a cap member housing the light emitting member therewithin and including at least one engaging leg to be engaged with the socket base member, and connection means carried by the socket base member for disengageably contacting a connection terminal of the light emitting member, the light emitting member being removably supported within the case member.

4 Claims, 6 Drawing Figures

ILLUMINATED DISPLAY ASSEMBLY

BACKGROUND OF THE INVENTION

The present inventin generally relates to a display assembly and more particularly to an improved illuminated display assembly in which a light emitting member is removably mounted.

Conventionally, there has been known an illuminated display assembly, for example, which is employed in an illuminated push-button switch. In the illuminated push-button switch, however, a light emitting member, for example such as a light emitting diode or the like, is connected to a fixed terminal of the switch by soldering, so that the switch must be differently produced in accordance with the type of the light emitting member. For instance, different illuminated push-button switches must be produced for flat and point emitting members and different color emitting members, respectively. Thus, the conventional illuminated display assembly has the disadvantage that its associated components must be differently produced for the different types of the light emitting members according to the respective desired purposes.

SUMMARY OF THE INVENTION

Accordingly, an essential object of the present invention to provide an improved illuminated display assembly in which a light emitting member is replaceably mounted with ease.

Another important object of the present invention is to provide an illuminated display assembly which removably mounted on an associated component thereof, such as a push-button switch component or the like.

According to the present invention, there is provided an illuminated display assembly comprising a light emitting member, a socket base member, a cap member housing the light emitting member therewithin and including a least one engaging leg to be engaged with the socket base member, and connection means carried by the socket base member for disengageably contacting a connection terminal of the light emitting member, the light emitting member being removably supported within the case member.

Other objects and advantages of the present invention will be apparent upon reference to the following description in conjunction with the accompanying drawings, in which:

DETAILED DESCRIPTION OF THE INVENTION

Figure 1:
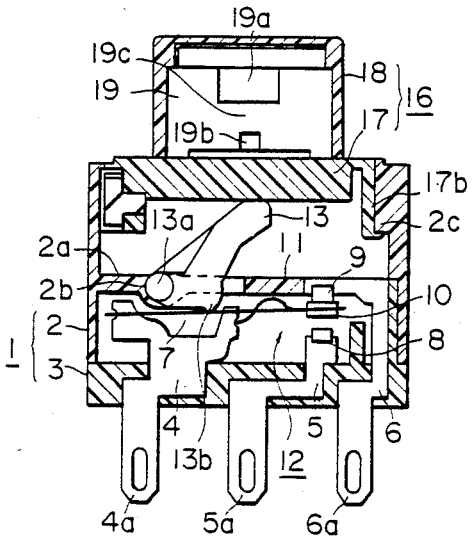
FIG. 1 is a front elevational view of an illuminated display assembly, which is employed in an illuminated push-button switch, as a preferred embodiment of the present invention.

Referring now, the FIG. 1, there is shown an illuminated display assembly which is employed in an illuminated push-button switch, as a referred embodiment of the present invention.

The switch includes a push-button member 16 which has a socket base 17, a cap 18 removably mounted on the base 17 and a light emitting member or element 19 housed within the cap 18, a housing body 1, supporting the push-button member 16 for a vertical movement, and a contact switching mechanism 12 actuated by the push-button member 16. The housing body 1 is made of a synthetic resin, and consists of a switching case 2 and a terminal base 3. The contact switching mechanism 12 includes stationary contact blades 4, 5 and 6 supported by the terminal base 3 by insert molding, a movable blade 7 at a base end thereof pivotably supported by the blade 4, and a reversing spring 11 supported between blades 7 and 4. The movable blade 7 at a free end thereof carries a movable contact 10 movable between a pair of stationary contacts 8 and 9 which are respectively disposed on the blades 5 and 6 at their upper ends.

A middle nail 2*a* formed in the case 2 pivotably supports a lever 13 by engaging a shaft receiver portion 2*b* thereof with a base shaft 13*a* of the lever. The lever 13 contacts a lower surface of the socket base 17, and includes an actuating portion 13*b* operatively engaged with the movable blade 7. The blades 4, 5 and 6 respectively extend through the base 3 outwardly, providing external connection terminals 4*a*, 5*a* and 6*a*.

Figure 2:
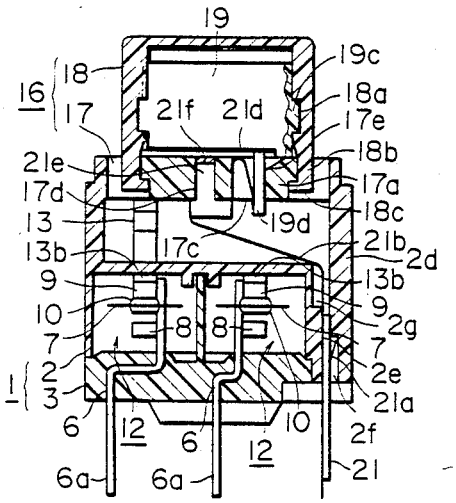
FIG. 2 is a side sectional view of the switch of FIG. 1.

The light emitting element 19 is a light emitting diode assembly providing flat plane radiation, and includes recesses 19*a* and 19*b*. As illustrated in FIG. 2, the element 19 further includes a pair of projections 19*c* on the opposite side walls thereof, which are engaged with recesses 18*a* formed on inner wall surfaces of the cap 18. The cap 18 includes a pair of downwardly extending opposite legs 18*b* finger portions 18*c* of which are adapted to be engaged with steps 17*a* formed in the socket base 17. As shown in FIG. 1, the base 17 further includes a nail leg portion 17*b* for engagement with a step 2*c* formed on the case 2 so that the movable base 7 upwardly biassed by the lever 13 is blocked or stopped by the step 2*c*.

Returning to FIGS. 2 and 3, a pair of external terminals 21 (only one terminal is shown in the drawings) are inserted through holes 2*e* so as to be engaged with steps 2*f* by finger levels 21*a*. The case 2 further forms a pair of recesses 2*g* so as to retain flux intruding along the terminals 21 on soldering the same, whereby upper connecting terminals 21*d* are prevented from being intruded by soldering flux. The terminals 21 include extending portions 21*b*, 21*c*, 21*d*, 21*e* and 21*f* are engaged with holes 17*d* of the base 17 so as to engage the socket terminal 21*d* with holes 17*c* and fix in the base 17 by folding the portions 21*f* on the base 17. On a upper and of the hole 17*d* there is provided a groove 17*e* for guiding lead terminal 19*d* of the element 19 to the socket terminal 21*d* as assembled.

In the above-mentioned arrangement, upon depression of the push-button member 16, the lever 13 swings about base shaft 13*a* in a clockwise direction and the movable blade 7 descends downward, so that the movable contact 10 moves from contact 9 to contact 8. As the member 16 is released from the depressing force, the lever 13 returns to its original position by the reset spring force of the reversing spring 11, and simultaneously the movable contact 10 comes into contact with the contact 9 and the push-button member ascends to its original position.

By connecting one of the terminals 21 with the terminal 5*a*, the light emitting element 19 may be designed to be energized when the contact 10 comes into contact with its contact 8 in response to the depression of the push-button member 16. Alternatively, the element 19 may be energized when the contacts 10 and 9 are closed. The cap 18 is made of optically transparent material, and adapted to be passed by lights from the element 17. Thus, when the element 19 is energized, plane light is emitted from an upper surface of the cap 18 above the element 19.

Figure 3:
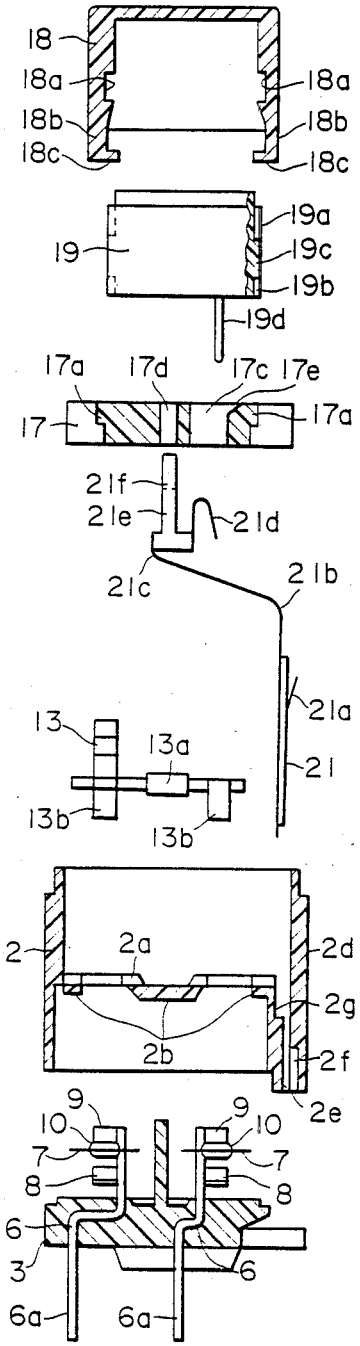
FIG. 3 is a disassembled view of the switch of FIG. 1.

In order to replace the light emitting element 19 with another one for repairing the element 19 or changing the illumination color thereof, the cap 18 may be removed from the socket base 17 together with the element 19 by disengaging the legs 18*b* from the steps 17*a*. Simultaneously its lead terminals 19*d* may be removed from the terminals 21*d*. The removed cap 18 enclosing the element 19 may be further disassembled by disengaging the projections 19*c* from the recesses 18*a* as illustrated in FIG. 3, so that a desired light emitting element may be installed within the cap 18. Thus, since other members than the light emitting element 19 are commonly used to change the element 19, the number of kinds of elements employed in the switch may be reduced to the minimum. That is, the cost for the assembled switch may be reduced.

Figure 4:
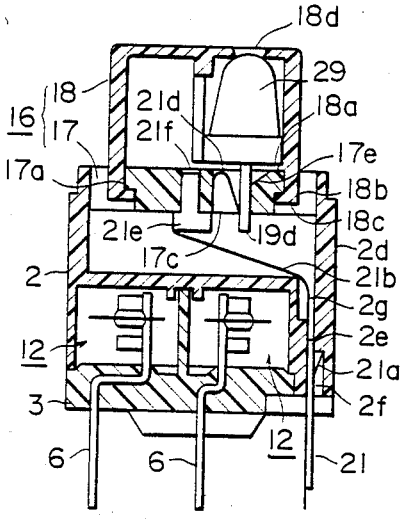
FIG. 4 is a side elevational view of an illuminated display assembly with which the illuminated display assembly in the switch of FIG. 2 is replaced, as a modification of the embodiment of FIG. 1.

Returning to FIG. 4, there is shown an illuminated push-button switch modified from the switch of FIG. 2 or 1. The modified switch employs a point light emitting element 29 in stead of the flat emitting element 19 of FIG. 2. The cap 18 is slightly so modified to include an aperture 18*d* as a light emitting window of the illuminated display assembly. Like reference numerals in FIGS. 4 and 2 designate like parts, and other operations of the switch of FIG. 4 are the same as the abovementioned embodiment.

Figure 5:
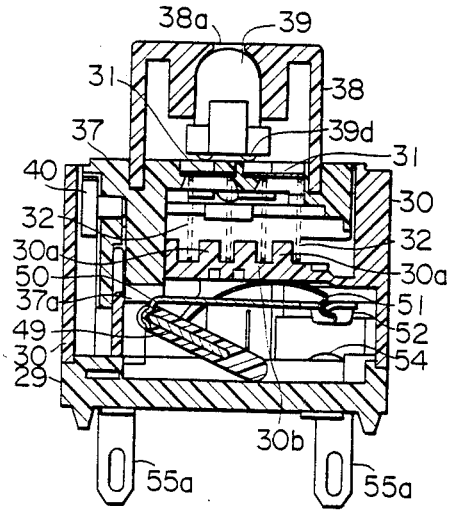
FIG. 5 is a front sectional view of an illuminated display assembly, which is employed in an illuminated push-button switch, as another embodiment of the present invention.
Figure 6:
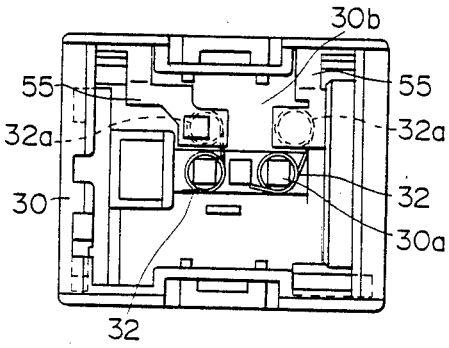
FIG. 6 is a plan view of a body of the switch of FIG. 5, in which the illuminated display assembly is removed.

In FIG. 5 there is shown an illuminated display assembly which is employed in an illuminated push-button switch as another embodiment of the present invention. A cap 38 housing a light emitting element 39 is mounted on a socket base 37 which is supported by a case 30 for a vertical movement. The base 37 includes an actuating portion at a lower and thereof so as to depress a movable blade 50 at a base end thereof hinged on a lever 49 by engagement with a free end of the lever 47. A biassing spring blade 51 is bridged between a free and of the blade 50 and the lever 49 so as to provide an over-travel snap action mechanism. Thus, upon the depression of the cap 38, the base 37 is depressed so that a pair of movable contacts 52 carried by the blade 50 come into contact with stationary contacts 54. External terminals (not shown in drawings) are internally connected with the contacts 54. The case 30 further includes a middle wall 30*b* bearing posts 30*a*. A pair of coil springs 32 are engaged with the post 30*a* so as to contact terminals 31 fixed on the base 37. The connection terminals 31 respectively extend upwardly so as to contact a pair of connection leads 39*d* of the element 39. The leads 39*d* are adapted to be inserted into spaces facing the terminals 31 for connection with the space. As shown in FIG. 6, the coil springs 32 contacting the terminals 31 include extensions 32*a* secured to the middle wall 30*b* by a pair of terminals 55. The terminals 55 are so inserted through the case 30 to provide external connection terminals 55*a* of the switch, whereby a pair of electrodes of the light emitting element 39 are connected to the external connection terminals 55*a* through connection terminals 31 and coil springs 32. The light emitting element 39 emits light through an aperture 38*a* of the case 38 when it is energized through the terminals 55*a*. The cap 38 may be removed together with the element 39 by disengaging a pair of lower legs (similar to the legs 18*b* of FIG. 2) from a pair of steps formed on the base 37 (similar to the steps 17*a* of FIG. 2). In the same manner as described in the foregoing embodiments, the element 39 may be replaced with another desired one with ease. The coil spring 32 bias the base 37 upwardly whereby switching operations by the switch are ensured. A cam 40 is so engaged with the base 37 that push-on-push off actions may be performed, viz., a first depression by the cap 38 provides keeping a close or on-position of the switch and a second depression thereby provides releasing the close position.

Although the present invention has been fully described by way of example with reference to the accompanying drawings, it it to be noted that various changes and modifications will be apparent to those skilled in the art. Therefore, unless otherwise such changes and modifications depart form the scope of the present invention, they should be constructed as included therein.

What is claimed is:

1. An illuminated display assembly comprising a case member a light emitting member removably supported within said case member, a socket base member, a contact switching means a cap member housing said light emitting member therewithin and including at least one engaging leg to be engaged with the socket base member, connection means carried by the socket base member for disengageably contacting a connection terminal of said light emitting member, housing means for supporting said socket base member for a slidable movement and for supporting said contact switching means therewithin, wherein said socket base member is adapted to actuate said contact switching means by depression of said cap member, and wherein said connection means has an upper end which is inserted in a hole formed within said socket base member and a lower end of which extends outwardly through said housing.

2. The illuminated display assembly of claim 1, wherein the connection means is a continuous blade terminal.

3. An illuminated display assembly comprising a case member a light emitting member removably supported within said case member, a socket base member, a contact switching means a cap member housing said light emitting member therewithin and including at least one engaging leg to be engaged with the socket base member, connection means carried by the socket base member for disengageably contacting a connection terminal of said light emitting member, housing means for supporting said socket base member for a slidable movement and for supported said contact switching means therewithin, wherein said socket base member is adapted to actuate said contact switching means by depression of said cap member and wherein said connection means comprises a connection terminal fixed on said socket base member, having a flexible member upper end which is connected to said connection terminal and a lower end which is connected to an upper end of an external terminal, whereby said light emitting member is connected to said external terminal through said flexible member.

4. The illuminated display assembly of claim 3, wherein the flexible member upper end is a coil spring.

* * * * *